United States Patent [19]

Gottlieb

[11] Patent Number: 4,494,537

[45] Date of Patent: Jan. 22, 1985

[54] BREATHING APPARATUS FOR SUPPLYING FLUID TO A USER ON DEMAND

[76] Inventor: Mark P. Gottlieb, 941-B 25th St., N.W., Washington, D.C. 20037

[21] Appl. No.: 386,396

[22] Filed: Jun. 8, 1982

[51] Int. Cl.[3] ..... A62B 7/00; B63C 11/00

[52] U.S. Cl. ..... 128/204.26; 128/201.28; 128/205.24

[58] Field of Search ..... 128/204.26, 201.28, 128/204.23, 205.15, 205.24; 137/489, 491

[56] References Cited

U.S. PATENT DOCUMENTS

| | | | |
|---|---|---|---|
| 2,875,756 | 3/1959 | Gagnan | 128/142 |
| 2,886,049 | 5/1959 | Holm et al. | 137/63 |
| 3,018,790 | 1/1962 | Kimes | 137/454.6 |
| 3,224,444 | 12/1965 | Dempster | 128/142 |
| 3,285,261 | 11/1966 | Chaney | 137/64 |
| 3,467,136 | 9/1969 | Le Masson | 137/489 |
| 3,467,137 | 9/1969 | Brown | 137/494 |
| 3,610,237 | 10/1971 | Barnet et al. | 128/204.28 |
| 3,626,975 | 9/1969 | Bobst et al. | 137/494 |
| 3,783,891 | 1/1974 | Christianson | 137/491 |
| 3,952,773 | 4/1976 | Hahn | 137/604 |
| 3,991,785 | 11/1976 | Trinkwalder, Jr. | 137/494 |
| 4,015,630 | 4/1977 | Contreras | 137/505.25 |
| 4,041,978 | 8/1977 | Leemann | 137/494 |
| 4,076,041 | 2/1978 | Christianson | 137/490 |
| 4,219,017 | 8/1980 | Shamlian et al. | 128/204.26 |
| 4,256,101 | 3/1981 | Ellestad | 128/204.26 X |
| 4,266,538 | 5/1981 | Ruchti | 128/204.26 |
| 4,274,404 | 6/1981 | Molzan et al. | 128/205.24 X |
| 4,289,126 | 9/1981 | Seireg et al. | 128/204.24 |
| 4,306,584 | 12/1981 | Schlobohm | 137/494 |
| 4,345,592 | 8/1982 | Giorgini et al. | 128/204.26 |
| 4,362,154 | 12/1982 | Le Masson | 128/201.28 X |

OTHER PUBLICATIONS

"Regulator Roundup", pp. 34–44, Jun. 1980, Skin Diver.

*Primary Examiner*—Edward M. Coven

*Attorney, Agent, or Firm*—Oblon, Fisher, Spivak, McClelland & Maier

[57] ABSTRACT

A servo assisted breathing apparatus for a scuba regulator is disclosed. The inhalation control diaphragm assembly and pilot valve are located in a casing attached to the mouthpiece. However, the air supply valve is directly connected to the regulator's first stage and is connected to the pilot valve by an elongated conduit which forms a portion of the control chamber. The elongated conduit and the air supply conduit are preferably coaxial.

8 Claims, 2 Drawing Figures

BREATHING APPARATUS FOR SUPPLYING FLUID TO A USER ON DEMAND

BACKGROUND OF THE INVENTION

1. Field of the Invention

The present invention relates to an apparatus for supplying air or other fluid to a user on demand. More particularly, the present invention relates to such an apparatus for use in an underwater breathing system, such as a Scuba system.

2. Description of the Prior Art

Scuba diving is a sport enjoyed around the world. Diving as a sport has been around for several decades, but it has only been in the past decade that the dive industry has attempted to make dive gear that is comfortable, attractive, compact and light weight.

Conventional scuba regulators consist essentially of two parts. A first stage fits on the tank, which is attached to the user's back. The tank contains air or other gas pressurized to between 2,000 and 4,000 psi when full. The first stage lowers the air pressure of the air leaving the tank to a constant pressure of about 130 psi above the ambient pressure out of "lower pressure" port, regardless of the remaining tank pressure.

Conventionally, the air from the first stage flows to the second stage through a flexible tube. A typical prior art second stage regulator is shown in U.S. Pat. No. 3,991,785. In this patent, a diaphragm is movable in response to the inhalation of the user. Inhalation can cause the diaphragm to move a spring loaded lever arm of a valve which releases pressurized air coming from the first stage. Thus, air is supplied to the user on demand as the user begins inhalation. Upon the user exhaling, the diaphragm returns to its original position, thus permitting the valve to close, while the exhaled gas is removed from the regulator through an appropriate exhaust valve.

However, these conventional regulators had two serious shortcomings. First, they were quite bulky, particularly the large pressure sensitive inhalation diaphragm which operated the second stage valve. This large size was not only unattractive, but also resulted in the regulators being so heavy that divers tended to get sore jaws following a long dive.

However, such a large size for the regulator could not be avoided because of the need to provide sufficient force on the second stage valve to force the valve open without excessive inhalation effort. Reducing the diaphragm size would have made breathing very difficult.

An alternative approach is shown in U.S. Pat. No. 2,875,756. Here, the second stage regulator, including a large diaphragm are located within a casing positionable on the tank. An intake conduit provides an inhalation signal to the diaphragm for opening the second stage valve while a delivery conduit directs the air to the mouthpiece. Although this design has the advantage of reducing the bulk at the mouthpiece, the positioning of the regulator, particularly the inhalation diaphragm for opening and closing the second stage valve, at the tank introduces several problems. First, the long intake conduit results in increased resistance during the initial inhalation, which makes breathing more difficult. More significantly, the diaphragm is not located at the same level as the head of the user so that a difference can exist between the pressure sensed by the diaphragm and the pressure to which the user is subjected. For example, during horizontal swimming the tank is located above the user and the regulator thus senses a lower pressure than that experienced by the user, resulting in insufficient air pressure delivered to the mouthpiece.

Recently, an improved type of regulator has appeared which overcomes some of the problems of the conventional regulator. These regulators, known as "servo assisted" regulators use a pneumatic amplifier system in the second stage to amplify the diver's breathing signal. One such system is shown in U.S. Pat. No. 4,219,017. In this prior art device, the second stage of the regulator is completely contained within a casing attached to the mouthpiece. In this device, the pressure sensitive inhalation diaphragm movable in response to user demand does not control the air supply valve but instead controls a sensitive pilot valve through a control lever. The pilot valve can be easily opened with a small breathing effort, thus permitting a reduction in the size of the regulator diaphragm. According to this prior art patent, the air supply valve includes a restriction which permits air to enter a control chamber between the air supply valve and the pilot valve. The air supply valve is in the form of a second diaphragm which is sensitive to pressure changes in the control chamber. Thus, the opening of the pilot valve causes a pressure drop in the control chamber which opens the air supply valve and thereby provides air to the user. It can thus be seen that the user's efforts are amplified so that breathing is possible without great effort, and without the need for a large regulator diaphragm.

However, the design of U.S Pat. No. 4,219,017 has an important shortcoming. Although the diaphragm area can be greatly reduced, the additional structure required by the pilot valve and control chamber, as well as the complexity of the air supply valve require that the casing to which the mouthpiece is attached be almost as big as a conventional regulator. Indeed, the volume of the smallest servo assisted regulator is about 70% of the volume of the conventional large diaphragm regulator. Therefore, the problems of unsightly appearance and excessive weight associated with the prior art remain.

SUMMARY OF THE INVENTION

It is an object of the present invention to provide a second stage Scuba regulator of reduced size and weight.

It is a further object of the present invention to provide a servo assisted Scuba regulator of reduced size and weight.

It is a further object of the present invention to provide a servo assisted Scuba regulator in which the control chamber and air supply valve are located away from the user's face.

According to the present invention, the pilot valve remains positioned in the casing to which the mouthpiece is attached. The casing also contains a diaphragm assembly which actuates the pilot valve control lever for opening the pilot valve upon user demand. However, unlike the prior art servo valve regulators, the air supply valve itself is attached directly to the first stage which is located on the air tank. A very thin tube is connected between the pilot valve and the air supply valve, and acts as part of the control chamber. Preferably, the thin tube connected between the pilot valve and the air supply valve is coaxial with the tube providing air flow from the air supply tube to the interior of the casing. Thus, by moving the air supply valve to a location adjacent the tank and by forming the control chamber as a tube connected between the pilot valve and the air supply valve, it is possible to greatly reduce the size of the casing to which the mouthpiece is attached.

A further advantage of the present invention is that the air supply tube carries air at ambient, rather than elevated pressure. Only the very small tube connected between the pilot valve and the air supply valve carries air at elevated pressure. Since the relatively large air supply hose is under no pressure, high pressure rigid hose material with thick walls is not necessary and the flexibility of this element can be increased.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
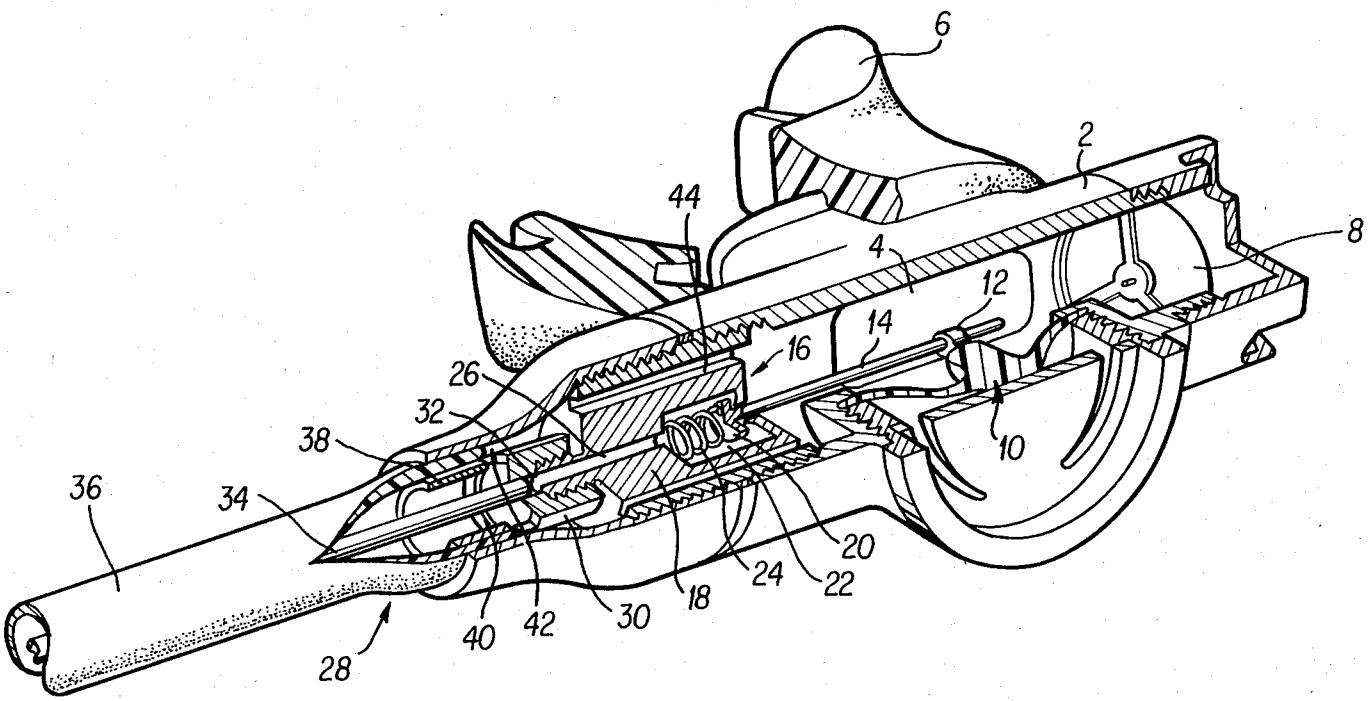
FIG. 1 is an perspective view, partially cut away, of the casing attached to the mouthpiece, and in which the pilot valve is positioned.

The preferred embodiment will now be described with reference to the attached drawings in which corresponding reference numerals will be used throughout the several views.

A hollow casing 2 is provided with an opening 4 which provides communication between the interior of the casing and a mouthpiece 6 attached to the casing. The shape and material of the casing may be conventional, and indeed, may be identical to that of U.S. Pat. No. 4,219,017, which is hereby incorporated by reference.

The casing includes an exhaust valve assembly 8 and a pressure sensitive inhalation diaphragm assembly 10. These elements are conventional and can also be identical to those of U.S. Pat. No. 4,219,017 but are not necessarily limited thereto.

The diaphragm assembly 10 includes a conventional pilot valve lever control guide 12 which is physically attached to the pilot valve control lever 14 of the pilot valve assembly 16. The pilot valve assembly consists of a pilot valve body 18 which is fixed, as by threading, in one end of the casing 2. The pilot valve 20 is located within a chamber 22 of the pilot valve body and is biased in a closed position by a spring 24 in the chamber 22. The pilot valve 20 is physically attached to the pilot valve control lever 14 so that the pilot valve can be unseated so as to communicate chamber 22 with the interior of the casing in response to movements by the pilot valve control lever 14. The operation and details of the pilot valve itself are conventional and can be identical to those of U.S. Pat. No. 4,219,017.

The chamber 22 is provided with a bore 26 which extends to the end of the pilot valve body facing the open end 28 of the casing. An adaptor 30, which will be more fully described below, includes a portion threaded to the end of the pilot valve body to which the bore 26 extends. The adaptor 30 is provided with a bore 32 which is coaxial with the bore 26 of the pilot valve body.

A control fluid conduit 34 extends into the end 28 of the casing and is fixedly inserted in the bore 32 of the adaptor 30. In addition, an air supply conduit 36, coaxially surrounding the control fluid conduit 34, has an end clamped between a flange portion 38 of the adaptor 30 and the inner wall of the casing adjacent the end 28. The flange 38 is provided with a circumferential array of apertures 40 through which air from the interior of the air supply conduit can flow. The air flowing from the apertures 40 can pass into the interior of the casing 2 via the annular passage 42 between the adaptor and the casing. Moreover, the pilot valve body is provided with a circumferential array of axial bores 44 through which the air can pass towards the remainder of the casing interior and the mouthpiece 6.

Preferably, the size of the control fluid conduit 34 should be as small as possible in order to reduce delays in response to the pilot valve actuation. It has been found that, for a conventional length air supply tube, the inner diameter of the control fluid conduit 34 should be approximately 1/16 inch.

The casing 2 can also contain a baffle which divides the casing into two interior sections, one containing the pilot valve assembly and the other containing the exhaust assembly 8. Such a baffle is conventional and can be of the type shown in U.S. Pat. No. 4,219,017.

The air supply valve assembly consists of a casing 46 containing the air supply valve body 48. The air supply valve body 48 includes an integral cover 50 closing one end of the housing 46, sealed by a conventional O-ring 52. The body 48 is extended by a threaded projection 54 containing an axial bore 56. The valve body 48 is securely threaded to a conventional regulator first stage at projection 54 so that pressurized air from the low pressure port of the first stage is supplied to the bore 56. A conventional regulator first stage is disclosed in U.S. Pat. No. 4,219,017.

The air supply valve body includes a hollow cup like cylindrical portion 58 forming a chamber closed by an end piece 60 threadedly secured therein. The end piece 60 is provided with an axial bore 62 extending therethrough. The end of the control fluid conduit 34 is clamped by the cap 64 in an air tight manner so that fluid communication is established between the conduit 34 and the bore 62.

The valve element itself consists of an elastic diaphagm 66 having a central bleed orifice 68 and secured in place by a clamping plate 70. The diaphragm is held, due to its own resilience, against the end wall of the valve body and thus covers a plurality of bores 72 extending through the base of the valve body and functioning to communicate the interior chamber of the valve body with the interior of the housing 46.

The valve body is preferably secured within the housing 46 by cooperating screw threads on the valve body and housing interior. In order to provide communication between the portions of the interior of the casing 46 on either side of the valve body 48, the screw threads on the valve body are preferably provided with a plurality of axial grooves 74.

The end of the air supply conduit 36 is clamped to the exterior of an extension 76 of the housing 46, said extension forming an aperture. The control fluid conduit 34, which is coaxial with the air supply conduit, passes through the aperture for securement to the end cap 64.

Figure 2:
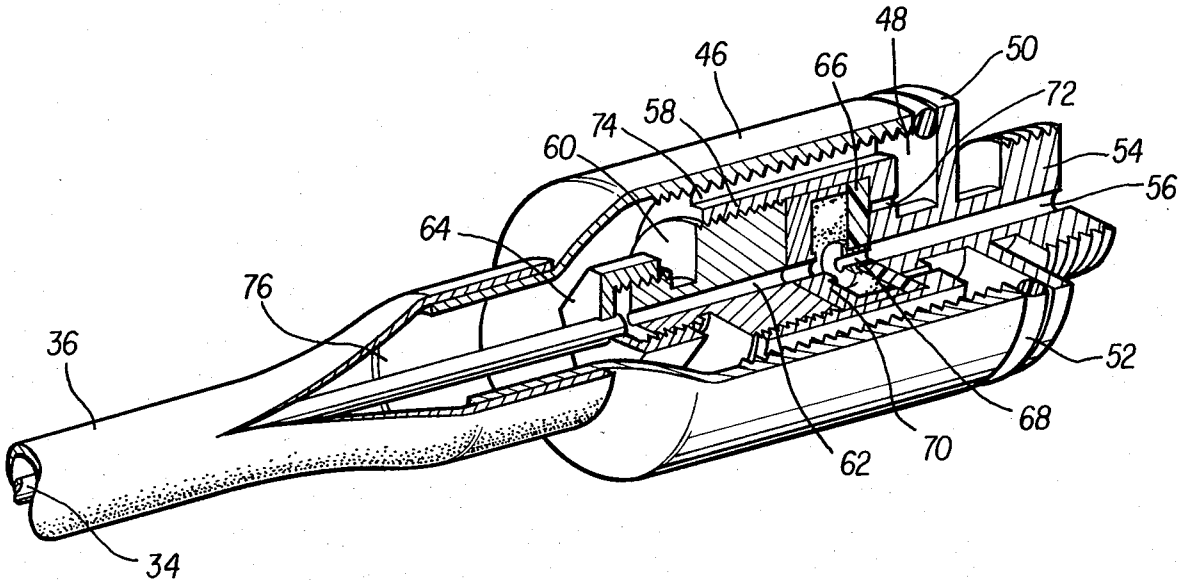
FIG. 2 is an perspective view, partially cut away, of the air supply valve assembly which is connected directly to the first stage of the regulator.

The apparatus of the present invention operates in the following manner. The air supply valve assembly is first attached to a low pressure outlet port of a conventional first stage via the projection 54. Accordingly, the bore 56 is provided with air at an intermediate pressure of approximately 130 psi. The pressurized air is sensed by the diaphragm 66 which initally bulges to the left (as seen in FIG. 2) permitting communication between the bore 56 and the plurality of bores 72 in the end wall of the valve body. However, pressurized air also bleeds through the bleed orifice 68 in the diaphragm, thereby raising the pressure in the bore 62, the control fluid conduit 34, the bore 26 and the chamber 22. When the pressure in these elements, which together comprise a control chamber, are equalized with the pressure in the bore 56, the diaphragm returns to the position shown in FIG. 2 wherein the diaphragm rests flush against the end wall of the valve body and closes communication to the bores 72. The regulator is then ready for use.

Additionally, the interior of the casing 2 is at ambient pressure and thus the pressures on either side of the diaphragm of inhalation diaphragm assembly 10 are equal. However, when a user having the mouthpiece in his mouth begins to inhale, there results a pressure drop within the casing 2. As a result, the ambient pressure causes the diaphragm of the inhalation diaphragm assembly 10 to move inward toward to interior of the casing. Since the diaphragm of the inhalation diaphragm assembly 10 is physically connected to the pilot valve control lever 14 through the pilot valve lever control guide 12, the pilot valve control lever 14 tilts, which simultaneously causes the pilot valve element 20 to tilt, thereby opening communication between the chamber 22 and the interior of the casing.

This communication between the chamber 22 and the interior of the casing causes a rapid drop of pressure in the control chamber comprised by the bore 26, the control fluid conduit 34, the bore 62 and the interior of the air supply valve body 48. The pressure drop is sensed by the air control valve diaphragm 66 which again flexes to the left, thereby providing communication between the bore 56 and the bores 72. Pressurized air will, of course, again bleed through bleed orifice 68, but so long as the user is inhaling, the pilot valve will remain open and will prevent repressurization of the control chamber. The pressurized air from the bores 72 passes through the grooves 74 between the air supply valve body and the casing 46 and through the air supply conduit 36. The pressurized air from the conduit 36 passes through the apertures 40 in the flange 38 and the bores 44 surrounding the pilot valve body, towards the aperture 4 leading to the mouth of the user.

Thus, the present invention provides the benefits of a servo assisted regulator in which only a small inhalation force is needed to activate the sensitive pilot valve. Yet at the same time, the additional bulk and weight for the servo system, which was, in the prior art, provided adjacent the user's mouth, is no longer within the casing 2 so that a truly compact and light weight regulator system is provided.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A breathing apparatus for supplying fluid to a user on demand, said apparatus comprising:

a source of fluid under elevated pressure;

a casing having an outlet for said user;

fluid supply valve means connected to said source, said fluid supply valve means being positioned adjacent said source;

a first conduit providing a fluid path between said fluid supply valve means and said casing;

pilot valve means in said casing;

means supplying a fluid signal from said pilot valve means to said fluid supply valve means for opening said fluid supply valve means wherein said means for supplying a fluid signal comprises a second conduit connected between said pilot valve means and said fluid supply valve means; and fluid pressure sensitive actuator means in said casing for actuating said pilot valve means;

wherein said fluid valve means includes means for supplying fluid under elevated pressure to said second conduit and wherein said second conduit is connected to said pilot valve means for supplying said fluid under elevated pressure to said pilot valve means and a valve element sensitive to a change of fluid pressure in said second conduit, said valve element being operative to provide a fluid flow path between said source and said first conduit.

2. The breathing apparatus of claim 1 including a first stage connected between said source and said fluid supply valve means.

3. The breathing apparatus of claim 1 wherein said casing comprises a hollow housing defining a first chamber, said housing including therein:

said outlet for said user;

a first aperture to which said first conduit is connected for providing a fluid flow path from said air supply valve means to said first chamber;

said pilot valve means;

an air exhaust valve; and said fluid pressure sensitive actuator means, wherein said fluid pressure sensitive actuator means includes means sensitive to the pressure in said first chamber and means connectable to said pilot valve means for actuating said pilot valve means.

4. The breathing apparatus of claim 1 wherein said pilot valve means includes release means actuatable by said fluid pressure sensitive actuator means for releasing said fluid under elevated pressure from said second conduit.

5. The breathing apparatus of claim 1 wherein said means for supplying fluid under elevated pressure to said second conduit includes fluid flow restriction means.

6. The breathing apparatus of claim 1 wherein said second conduit is inside of, and coaxial with, said first conduit.

7. A breathing apparatus for supplying fluid to a user on demand, said apparatus comprising:

a source of fluid under elevated pressure;

a casing having an outlet for said user;

fluid supply valve means connected to said source, said fluid supply valve means being positioned adjacent said source;

a first conduit providing a fluid path between said fluid supply valve means and said casing;

pivot valve means in said casing;

means supplying a fluid signal from said pilot valve means to said fluid supply valve means for opening said fluid supply valve means wherein said means for supplying a fluid signal comprises a second conduit connected between said pilot valve means and said fluid supply valve means, and fluid pressure sensitive actuator means in said casing for actuating said pilot valve means, wherein said fluid supply valve means comprises:

a housing having an inlet in fluid communication with said source, said housing further having an outlet opposite said inlet, said first conduit being connected to said outlet for providing fluid communication between the interior of said housing and said first conduit;

a valve body fixed in said housing and dividing the interior of said housing into a first chamber adjacent said inlet and a second chamber in fluid communication with said outlet;

a valve element in said valve body for providing selective fluid flow between said inlet and said first chamber; and third conduit means defined by said housing and said valve body for providing fluid flow between said first and second chambers.

8. The breathing apparatus of claim 7 wherein said valve body is fixed in said housing by screw threads in said housing and on said valve body, said third conduit means comprising at least one axial groove in said screw threads.

* * * * *